US005599077A

United States Patent [19]

Law et al.

[11] Patent Number: 5,599,077

[45] Date of Patent: Feb. 4, 1997

[54] CABINET LOCKING SYSTEM

[75] Inventors: Andrew J. Law, Bradford; Raymond Parker, Leeds, both of United Kingdom

[73] Assignee: Flexiform Business Furniture Limited, Bradford, United Kingdom

[21] Appl. No.: 393,991

[22] Filed: Feb. 24, 1995

[30] Foreign Application Priority Data

Feb. 25, 1994 [GB] United Kingdom ..... 9403629

[51] Int. Cl.[6] ..... E05C 7/06

[52] U.S. Cl. ..... 312/221; 312/216; 312/215

[58] Field of Search ..... 312/215, 216, 312/217, 221, 222

[56] References Cited

U.S. PATENT DOCUMENTS

| | | | |
|---|---|---|---|
| 3,888,558 | 6/1975 | Himsl | 312/216 |
| 4,272,138 | 6/1981 | Stark | 312/221 |
| 4,303,287 | 12/1981 | Taplin | 312/215 |
| 5,411,327 | 5/1995 | Norton | 312/221 |

*Primary Examiner*—Peter R. Brown
*Assistant Examiner*—Anthony D. Barfield
*Attorney, Agent, or Firm*—Cushman Darby & Cushman IP Group of Pillsbury Madison & Sutro LLP

[57] ABSTRACT

A combined locking and anti-tilt device (1) for a cabinet, and a cabinet including such a locking and anti-tilt device, having a plurality of drawers (3) mounted so as to be slidable out of the cabinet, comprising a guideway (G), and, slidably mounted within the guideway (G), a plurality of block units (7), a part (9) of each block unit (7) projecting to a position engageable by part (5) of an adjacent drawer (3), opening of a drawer (3) causing movement of an adjacent block unit (7) in a direction towards a first end of the guideway (G), the length of the guideway (G) within which the block units (7) may slide being limited such that the extent of movement of the block units (7) is limited, and a lock mechanism comprising a locking member (11) movable between a locked position and an unlocked position, is characterized in that the locking mechanism also comprises an elongate locking element (13) extending from the first end of the guideway (G) to at least the region of the locking member (11); the locking element (13) is secured to the first block unit (15) closest to the first end of the guideway (G) but arranged for relative movement with respect to the other block units (7); and the lock element (13) includes a lock engagement member (45) arranged such that in the locked position of the locking member (11), movement of the first block (15) towards the first end of the guideway (G) causes the lock engagement member (45) of the lock element (13) to engage against the locking member (11) thus limiting movement of the first block (15).

9 Claims, 6 Drawing Sheets

G
38
15
45
44
5
9
17
43
50
7
35
7

CABINET LOCKING SYSTEM

BACKGROUND OF THE INVENTION

The present invention relates to a device for locking a cabinet having a plurality of drawers, the device also serving as an anti-tilt mechanism for the cabinet. The invention is applicable with particular advantage to tall cabinets.

In the following specification, the term "cabinet" will be used to describe filing cabinets and other items of furniture within which there are mounted drawers for access or use. They include domestic furniture, office cabinets, laboratory furniture, kitchen furniture and indeed any item of furniture having a plurality of drawers. The furniture does not need to be enclosed. Open racking can be fitted with units that slide out and the invention can be equally applied in this case.

The term "drawer" will be used in its broadest sense to mean a thing capable of being drawn out, which apart from encompassing a standard slidable box, also includes shelves, trays and frames from which files can be suspended or otherwise supported.

Cabinets often have a plurality of drawers which are fixed to the cabinet and when slid out remain supported by it cantilevered out beyond the base of the cabinet. If several of the drawers are withdrawn simultaneously and are heavy or carry weight, for example, those drawers full of office files, there is a serious risk that the cabinet may tilt forward. A number of devices have been proposed which act as a safety device to limit the number of drawers which can be withdrawn at the same time. Indeed, in some countries all office filing cabinets have to include such a safety device.

One such device is described in GB Patent 2 095 322. This patent describes a safety device which comprises a guide extending up a wall of the cabinet and blocking elements for the drawers of the cabinet. The blocking elements can be moved along the guide to release the drawer but limited free length on the guide restricts the number of drawers which can be released simultaneously, preferably to one only.

In the example shown in the above patent, the blocks are movable manually up and down the guide which can sometimes prove cumbersome. The device described includes no means for locking all of the drawers in a closed position. A number of improvements to this design have attempted to use the movable blocks to lock all of the drawers closed. The majority of such mechanisms comprise a lock mounted at the top of the cabinet with a lock mechanism which blocks the top of the guide to prevent upward movement of any of the blocks. The disadvantage of such a system is that in a tall cabinet the lock can at times be inaccessible.

SUMMARY OF THE INVENTION

According to the invention, there is provided a combined locking and anti-tilt device for a cabinet having a plurality of drawers mounted so as to be slidable out of the cabinet, comprising a guide, and, slidably mounted within the guide, a plurality of block units, a part of each block unit projecting to a position engageable by part of an adjacent, operatively associated drawer, opening of a drawer causing movement of an adjacent block unit in a direction towards a first end of the guide, the length of the guide within which the block units may slide being limited such that the extent of movement of the block units is limited, and a lock mechanism comprising a locking member movable between a locked position and an unlocked position, characterized in that the locking mechanism also comprises an elongate locking element extending from the first end of the guide to at least the region of the locking member; the locking element being secured to the first block unit closest to the first end of the guide but arranged for relative movement with respect to the other block units; and the lock element includes lock engagement means arranged such that in the locked position of the locking member, movement of the first block towards the first end of the guide causes the lock engagement means of the lock element to engage against the locking member thus limiting movement of the first block.

Thus the locking member can be mounted to any point within the cabinet since the locking element extends from the region of the locking member to the end of the guide limiting movement of the end blocking unit and thus all of the blocking units and therefore preventing the opening, withdrawal, or removal of any of the drawers.

The cabinet may be adapted to include vertical drawers such that the guide is horizontally aligned with the floor of the cabinet. However, typically the cabinet is an upright cabinet with horizontal drawers so that the first end of the guide is uppermost. The cabinet may not include just drawers, and thus the guide only has to extend in the region of the drawers. However, in many cases the guide extends the full length of the cabinet, and thus the invention is particularly advantageous when the cabinet is tall, since the lock can be positioned at any conventional height for the user.

Preferably the locking mechanism includes a standard locking bar known in the art where rotation of a key in a lock causes movement in a transverse direction of a horizontal bar.

Preferably the locking member is arranged such that when in its locked position, it can also engage the adjacent block unit for extra security.

For example, the adjacent block may include a bore into which the locking member may extend when in its locked position.

The elongate locking element has to be such that it does not impede the movement of the drawer. In one embodiment, an elongate rod with a series of projections forming the lock engagement means can be used. Here the locking member comprises a locking rod extending transverse to the elongate rod which in its locked position engages across the locking element such that the projection bears against the lock mechanism to prevent any movement.

In an alternative and preferred embodiment, the elongate locking element comprises an elongate plate which passes over the block units and includes at least one slot into which the lock member may extend when in its locked position. The edge of the slot forms the lock engagement means of the locking element which engages against the lock member to restrict the movement of the locking element with respect to the lock member.

For ease of manufacture, the plate typically includes a plurality of such slots spaced along its length. In this way the same design of plate may be used in a variety of cabinets having locking mechanisms mounted at different positions. The locking element does not have to prevent movement of the block units, but simply to restrict the movement sufficiently to not allow opening of a drawer.

A cabinet typically includes on each drawer a projecting elongate member with a tapered nose which engages against an adjacent block unit. Preferably the block units adjacent to the nose of each drawer extension have mounted upon them a roller which is the part engageable by part of the drawer such that opening of a single drawer automatically moves the block units above that drawer in a direction towards the first end of the guide in a smooth movement. In their raised position, such rollers block the movement of any other drawer projections. Preferably the block units are arranged such that rollers in adjacent pairs are positioned such that opening of a drawer causes engagement of part of the drawer between the rollers of the adjacent block units. This is especially useful when the part of the drawer which engages the rollers is the elongate member with a tapered nose.

It will be readily appreciated by one skilled in the art that there are many different shapes, materials and forms of block units which could be used in the invention.

The scope of applicability of the present invention will become apparent from the detailed description to follow, taken in conjunction with the accompanying drawings, in which like parts are designated by like reference characters.

BRIEF DESCRIPTION OF THE DRAWING

Two embodiments of combined locking and anti-tilt devices for cabinets will now be described, by way of example only, with reference to the accompanying drawings in which.

DESCRIPTION OF THE PREFERRED EMBODIMENT

Figure 1:
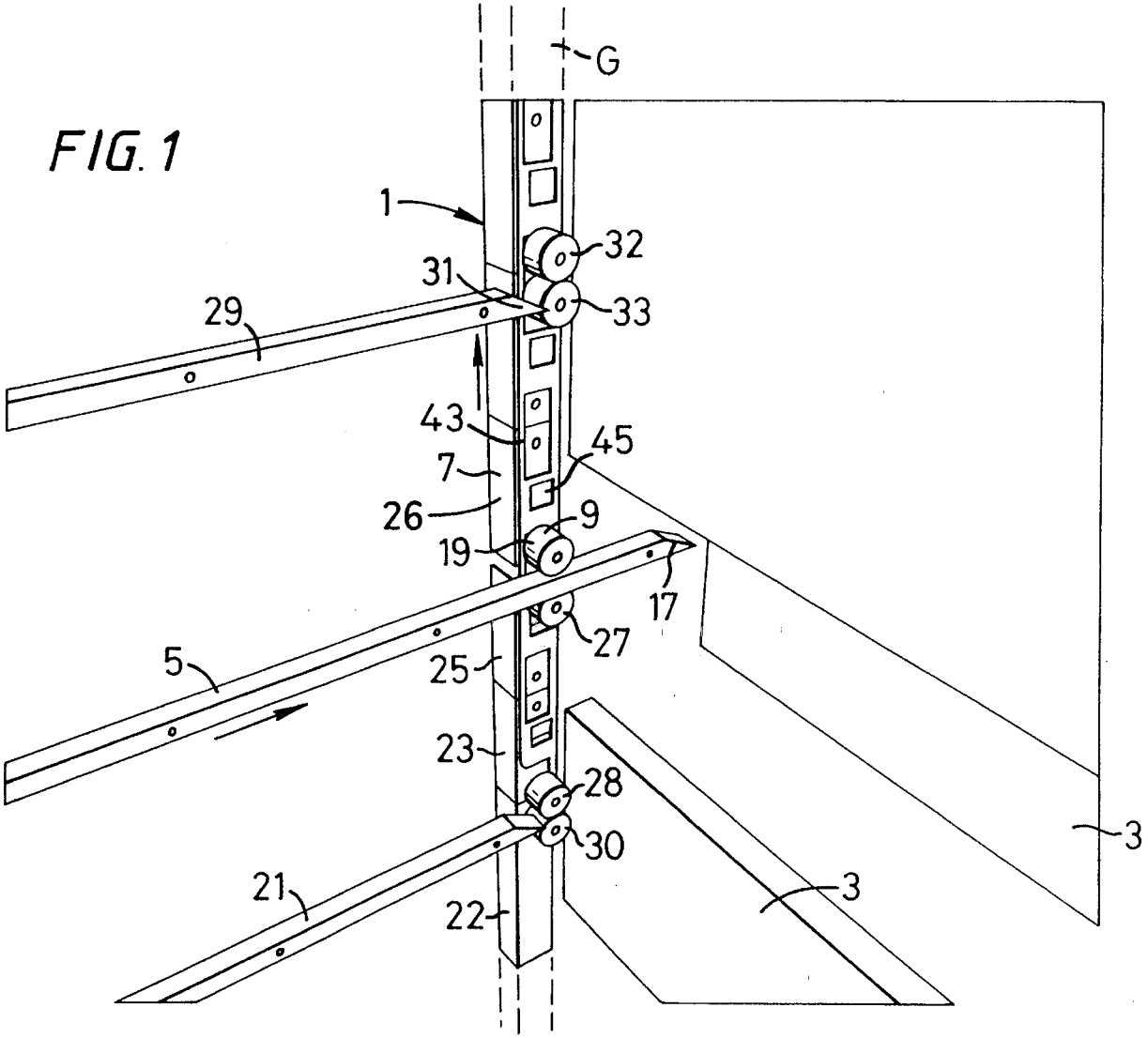
FIG. 1 is a schematic perspective view of the first embodiment illustrating the opening of a drawer (with the drawer assembly and cabinet side removed)
Figure 2:
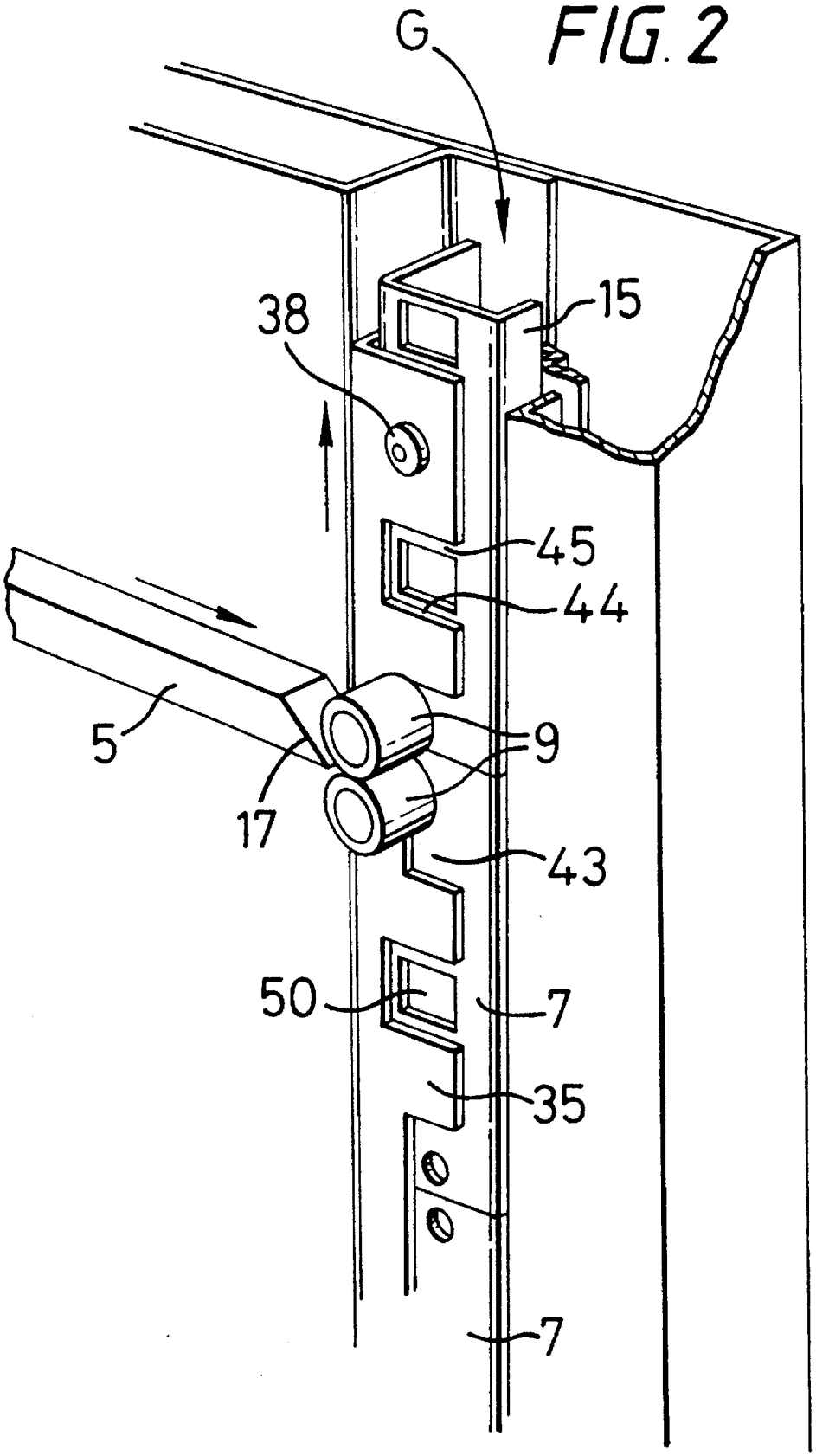
FIG. 2 is a perspective view of a portion of the structure illustrated in FIG. 1.
Figure 3:
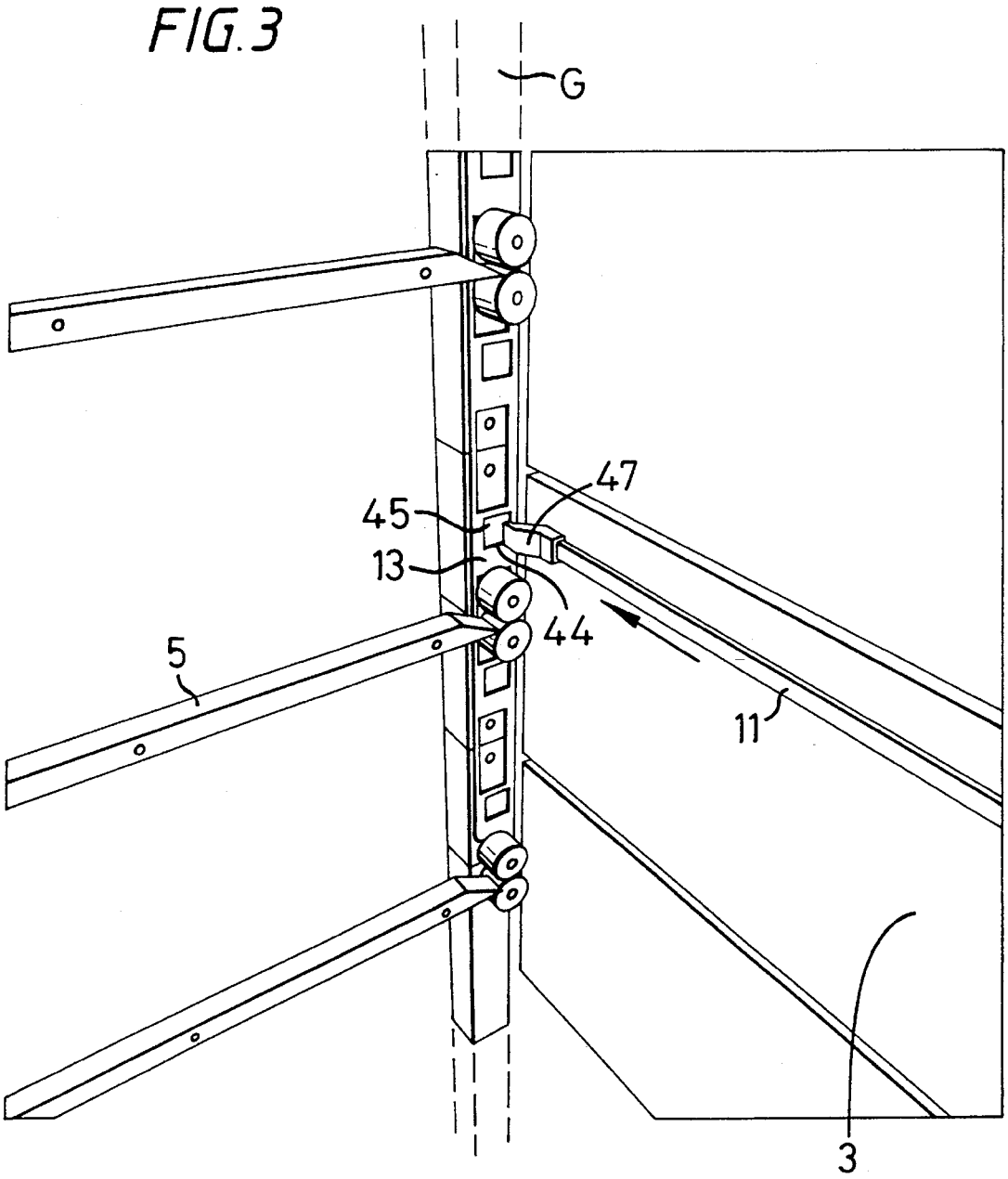
FIG. 3 is a schematic view of the device of FIG. 1 illustrating the locking member in its unlocked position.
Figure 4:
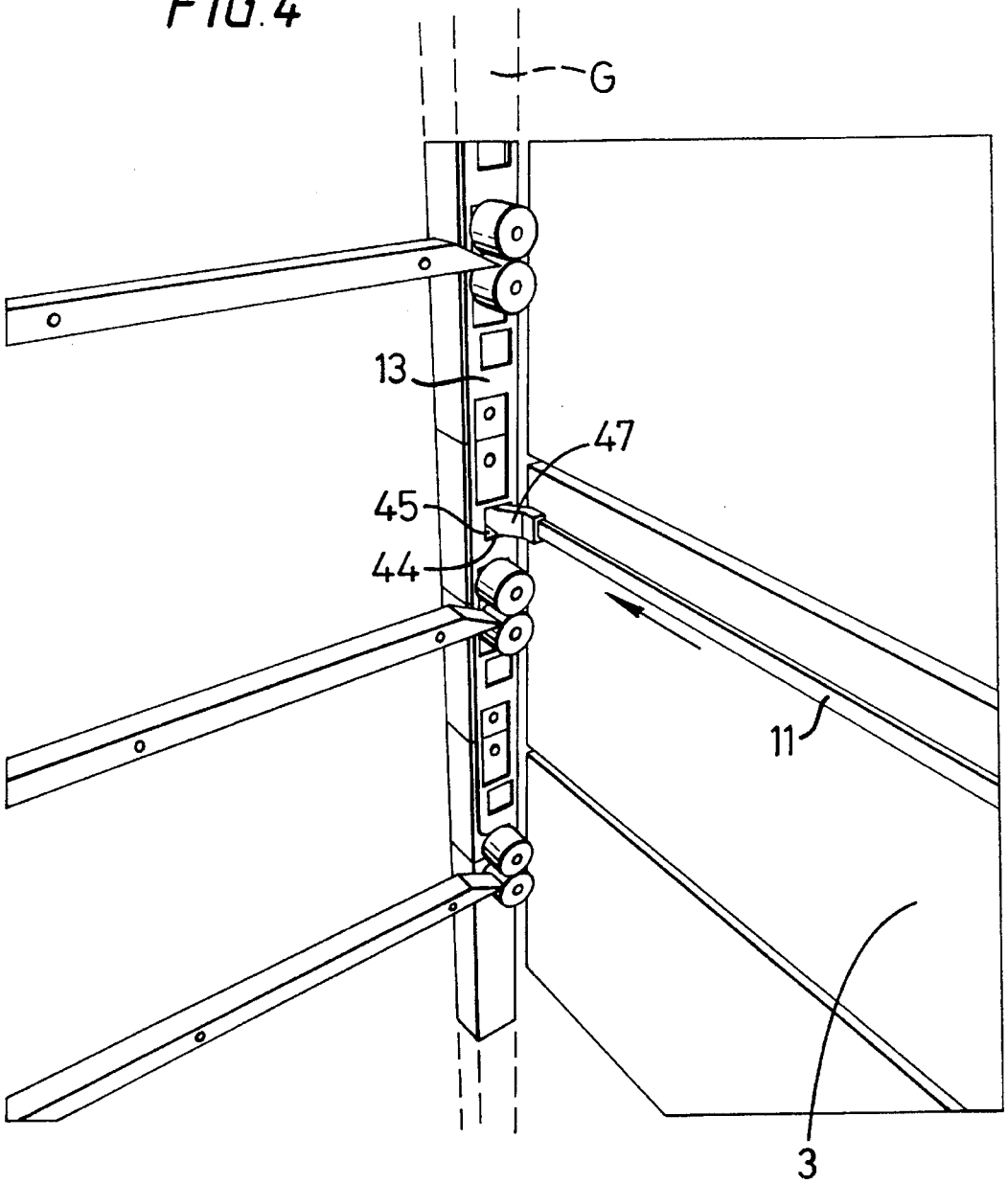
FIG. 4 is a view similar to FIG. 3 with the locking member in its locked position.

A first example of a combined locking and anti-tilt device 1 for an exemplary multi-drawer cabinet is illustrated schematically in FIGS. 1 to 5 of the accompanying drawings. In the figures, the structure of the cabinet and other selected structure is not shown for reasons of clarity. The cabinet has a plurality of drawers 3 that are typically fabricated as parallelepipeds, each represented in the drawing by their respective front panels, mounted so as to be slidable toward and to an open or extended position (i.e., to the right in FIGS. 1, 3, and 4). Each drawer 3 has a side rail 5 mounted or secured upon its side, typically upon a side panel (not shown) of each drawer 3. The device 1 includes a guideway that, in the embodiment illustrated, is channel-shaped, upright, elongate, and mounted at or defined by the side structure of the cabinet. In FIGS. 1, 3, and 4, the guideway is represented in generic dotted-line fashion and is designated generally by the reference character G. The structure of those surfaces (unnumbered) of the cabinet side panel that form the channel-shaped guideway G of the illustrated embodiment is shown in more detail in FIG. 2.

A plurality of block units 7 are slidably mounted within the guideway G in a stacked or superposed relationship as shown. As shown in FIG. 2, the first or uppermost block unit is designated by the reference character 15. Each block unit 7,15 is hollow and of U-shaped cross-section, as can be seen more clearly in the perspective view of FIG. 5. Displacment of a block unit 7 upwardly in the guideway G will also lift the block units 7 thereabove. As explained more fully below, each block unit 7 includes a component or part (i.e., part 9 in FIG. 1) that normally assumes a position in which it can be subject to engagement by a corresponding component or part (i.e., part 5) of its operatively associated drawer 3. In the case of the structure of FIG. 1, the opening of the mid-position drawer 3 intermediate the upper and lower drawers in the direction of the arrow causes the part 5 (mounted on the drawer) to engage the part 9 of its adjacent, operatively associated block unit 7 and move the so-engaged block unit 7 in a direction towards the first end of the guideway G, in this case in an upwards direction as indicated by the vertically aligned arrows in FIGS. 1 and 2. In addition to the movement of the block unit 7 caused by the direct engagement of the parts 5 and 9, all block units 7 above the so-moved block unit 7 will also be lifted upwardly towards the first end of the guideway G.

As explained in more detail below, the device 1 also includes a locking mechanism having a locking member 11 movable from a locking position, shown in FIG. 4, to an unlocked position, as shown in FIG. 3, and an elongate locking element 13 which extends from the region of the locking member 11 to the first end of the guideway G and which is also secured to the first block unit 15 closest to the first end of the guideway G but arranged for relative movement with respect to the other block units 7 below the first block unit 15.

In the locked position of the locking member 11 (FIG. 4), movement of the first block 15 towards the first end of the guideway G causes the base or lower edge 44 of a locking slot 45 of the locking element 13 to engage against the end of the locking member 11 to thus limit movement of the first block 15.

In the exemplary embodiment of FIGS. 1–5, the part 5 is defined by the drawer side rail 5 which also includes a tapered nose 17 at its front-facing end. Each block unit 7,15 has a roller, designated generically by the reference character 9, mounted thereon at each end thereof. The rollers 9 correspond to the part 9 that is positioned or projects into the path of the side rail 5 of the drawer 3 as the drawer 3 is moved toward and to its opened position. When all the drawers 3 are in their respective closed positions, the rollers 9 are arranged so that rollers 9 of adjacent block units 7 are in contact with one another when the block units 7 are in contact with one another.

The opening of a drawer 3 and the consequent movement of an operatively associated block unit 7 is illustrated in FIG. 1. As the drawer 3 is moved towards and to its opened position, the drawer side rail 5 moves forward in the direction of the arrow until the tapered nose 17 enters the nip between the subjacent roller 27 and the superjacent roller 19 of two contiguous block units 25,26. As the tapered nose 17 of the side rail 5 engages the roller 19, the roller 19 and its connected block unit 7 is displaced upwardly. Because no other drawer 3 is in the open position, there is enough room within the guideway G for the block units 7 above the extended side rail 5 to be lifted or displaced upwardly in the guideway G by a distance that is determined by the vertical thickness of the side rail 5. The co-action of the roller 19 and the tapered nose 17 facilitates a smooth movement of the block units 7 above the side rail 5 in the guideway G as the side rail 5 of the opened drawer 3 moves or lifts the block units 7 above the side rail 5 upwardly in the guideway G. The interposition of the side rail 5 of the now-opened drawer 3 between its operatively associated rollers 19,27 effectively blocks or bars upward movement of the block units 7 associated with the closed drawers 3 below the opened drawer 3. Accordingly, the drawers 3 below the now-opened drawer 3 cannot be pulled towards their open positions because the block units 7 cannot be moved upwardly in the guideway G; any upward movement by any of the block units 7 below the opened drawer 3 is blocked by the engagement of the roller 27 with the underside of the side rail 5 of the opened drawer 3. While the side rail of any closed drawer 3 below the opened drawer 3 can attempt to enter the nip between its operatively associated rollers (e.g., the side rail 21 and the rollers 28,30 in FIG. 1), that closed drawer 3 cannot be pulled outwards since the attempted upward movement of the superposed block units 23,25 is blocked by the roller 27 bearing against the underside of the side rail 5 of the opened drawer 3. This arrested mobility applies to any drawer 3 mounted below the open drawer 3.

The interposition of the side rail 5 of the opened drawer 3 between the rollers 19,27 displaces the block units 7 in the guideway G above the opened drawer 3 upwardly by a distance that is a function of the vertical thickness of the side rail 5. The dimensions of the parts are selected so that the nip between any two rollers above the opened drawer 3 is sufficiently displaced that the operatively associated side rail cannot enter its nip. More specifically, the side rail 29 of the drawer 3 above the open drawer 3 in FIG. 1 cannot be moved towards its open position since its tapered nose 31 will bear against and be blocked from further movement by a roller 33. The side rail 29 cannot enter the nip between the two adjacent rollers 32,33 so that no further forward movement of the drawer 3 toward the open position is allowed.

Figure 5:
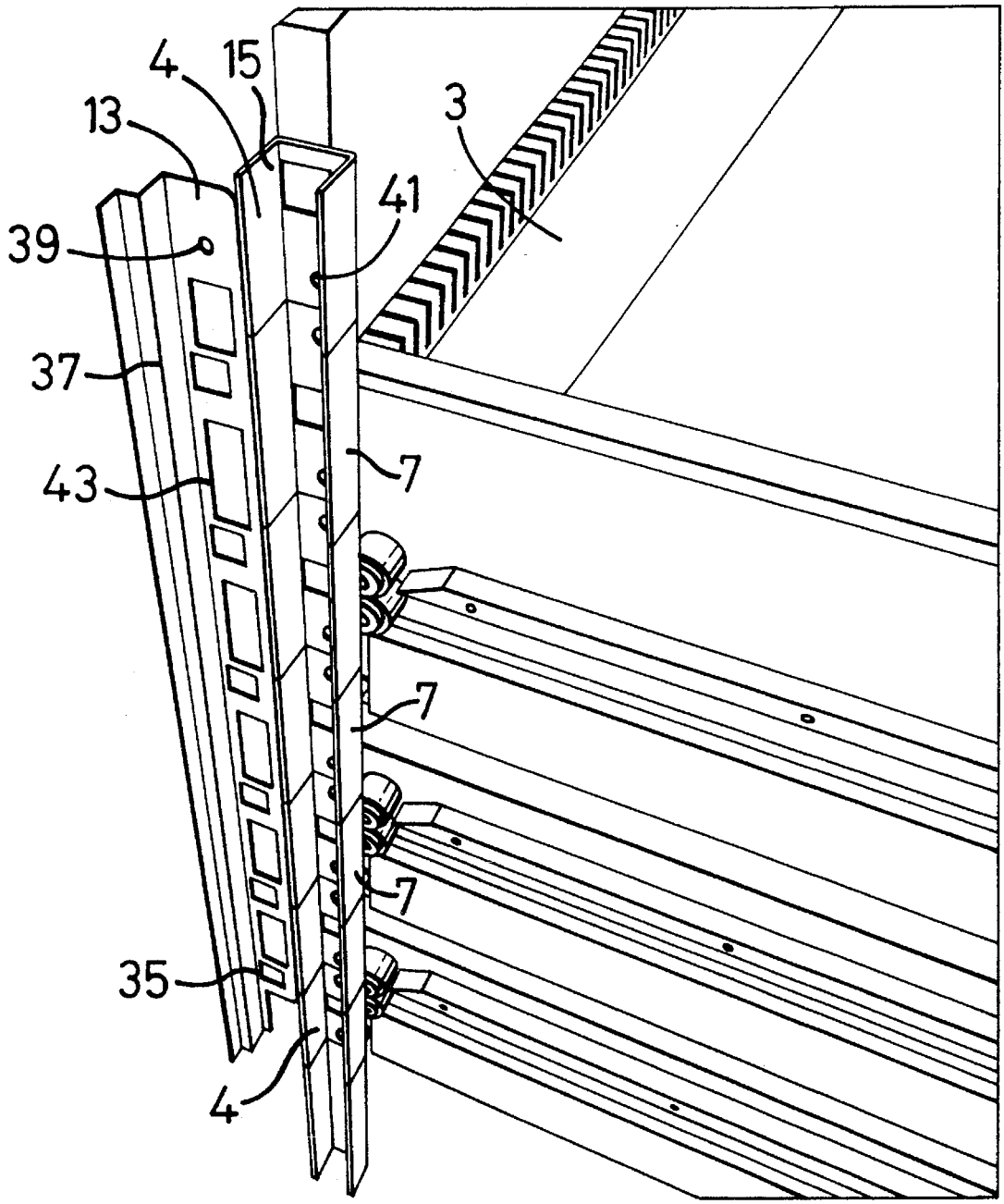
FIG. 5 is an exploded view of the first system with the cabinet side removed.

The elongate locking element 13 is defined by an elongate ladder strip 35 coupled to projecting flanges 37 that guide and confine the ladder strip 35. As shown in FIGS. 2 and 5, the ladder strip 35 is secured to the first or uppermost block unit 15 through a bolt 38 (FIG. 2) or other fastener passing through holes 39,41 (FIG. 5) to ensure that relative movement between the ladder strip 35 and the first block unit 15 is not permitted. The ladder strip 35 lies over the front face of the block units 7 and includes a plurality of elongate slots 43 (FIG. 2) through which the various rollers may pass. When in the position shown in FIG. 1 in which a drawer 3 is open, the plate-like ladder strip 35 moves upwards with the block units 7.

The ladder strip 35 also includes a plurality of locking slots 45, only one of which is used as shown in FIGS. 3 and 4. The locking member 11 is coupled to a locking mechanism, such as a key-operated lock (not shown) which ensures that, in its locked position, the horizontally aligned, bar-like locking member 11 moves such that its end 47 enters into and engages a locking slot 45. By effecting this relative movement between the locking member 11 and the elongate member 13, the ladder strip 35 is effectively locked or secured against movement. This means that movement of the first block unit 15 is prevented since the lower edge 44 of the locking slot 45 will bear against the end of the locking member 11. Thus and as explained above, all of the block units 7 beneath the now-locked first block 15 are also locked in position. This effectively ensures that none of the drawers 3 can be opened. As shown in the detail of FIG. 2, the block units 7,15 can include apertures 50 in general registration with the locking slot 45 which are also intended to receive the end 47 of the locking member 11.

Figure 6:
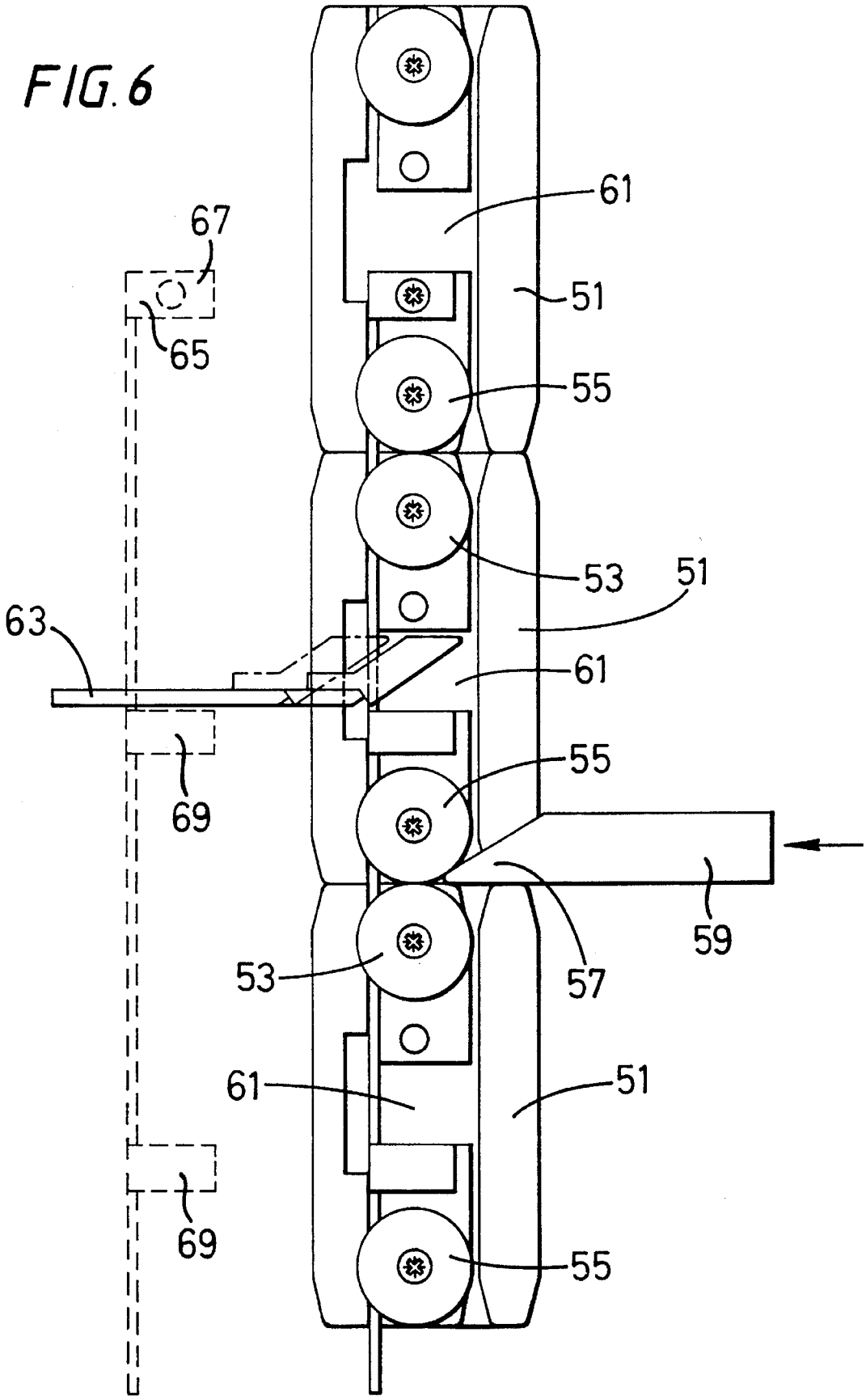
FIG. 6 is a schematic section through a second embodiment of the invention.

In an alternative embodiment illustrated in FIG. 6, each of the block units 51 is of more solid construction and has mounted upon it two rollers 53,55. The mechanism for opening and closing the drawers however is similar to that described in connection with FIGS. 1 to 5 in that the tapered nose 57 of a drawer side rail 59 enters the nip between and engages two adjacent rollers 53,55 as a drawer 3 is moved toward and to its open position (to the left in FIG. 6). Each of the block units 51 includes a central bore 61 into which may be engaged a locking bar 63 which prevents movement of the engaged block unit 51 and any block units 51 therebelow, but still allows freedom of movement of any block units 51 above the locked-in-place block unit 51. An elongate locking element 65 is illustrated schematically in a dotted-line illustration. The top end 67 of the locking element 65 is affixed to the uppermost block unit 51 and projections 69 are positioned such that, on engagement of the locking bar 63, upward movement of the uppermost block unit 51 would cause the projection 69 to bear against the locking bar 63 so that the upward movement is limited.

It will be appreciated that the invention is applicable to systems where the guideway G is arranged horizontally and the blocks move horizontally. Such a horizontally organized system would require means to restore or return the block units to their original positions upon closure of a drawer.

As will be apparent to those skilled in the art, various changes and modifications may be made to the illustrated cabinet locking device of the present invention without departing from the spirit and scope of the invention as determined in the appended claims and their legal equivalent.

What is claimed is:

1. A cabinet provided with a plurality of drawers mounted so as to be slidable out of the cabinet, said cabinet including a combined locking and anti-tilt device which comprises:

a guideway jointed to said cabinet and having first and second ends;

a plurality of block units slidably mounted in adjacent relationship within the guideway, each unit including a projecting portion engageable by an adjacent drawer whereby when one of said drawers is actuated so as to slide out of the cabinet, said block units between said actuated drawer and the first end of the guideway are displaced towards said first end;

a locking member movable between a locked position, and an unlocked position; and an elongated locking element extending from the first end of the guideway towards the second end to a location proximate the locking member, the locking element being secured to the block unit closest to the first end of the guideway so as to be movable therewith relative to the remaining block units, said locking element including lock engagement means arranged to contact the locking member when said member is in the locked position and when block units are displaced towards said first end of the guideway to thereby prevent further displacement of the block units.

2. A cabinet according to claim 1, wherein the locking member in its locked position engages a block unit adjacent thereto.

3. A cabinet according to claim 1, wherein the locking element comprises an elongated rod, the lock engagement means comprises a projection from said rod, and the locking member comprises a locking rod extending transverse to the elongated rod which, when in its locked position, is contacted by the projection to limit movement of the block unit closest to the first end of the guideway.

4. A cabinet according to claim 1, wherein the locking element comprises an elongated plate which extends along the block units and which includes at least one slot into which the locking member extends in its locked position, the slot having an edge which forms the lock engagement means.

5. A cabinet according to claim 4, wherein the plate includes elongated slots through which the projecting portions pass, the length of the slots being sufficient to permit relative movement between the plate and the block units.

6. A cabinet according to claim 1, wherein the projecting portion of each block unit comprises a rotatably mounted roller.

7. A cabinet according to claim 6, wherein adjacent block units include said rollers arranged in adjacent pairs whereby when a drawer is displaced to slide out of the cabinet, the rollers of an adjacent pair are engaged and separated by the drawer, the block unit associated with one of the pair of rollers being moved towards the first end of the guideway and the block unit associated with the other of the pair of rollers being restricted against movement towards said first end.

8. A cabinet according to claim 7, wherein each block unit has a pair of projecting portions comprising rollers mounted at opposite ends of the block unit.

9. A cabinet according to claim 1, wherein each of said drawers includes an elongated side rail having a tapered nose for engaging a respective adjacent projecting portion of said block units.

* * * * *